US009751025B2

(12) United States Patent
Kiribuchi

(10) Patent No.: US 9,751,025 B2
(45) Date of Patent: Sep. 5, 2017

(54) MAGNETIC BLOCK TOY

(71) Applicant: People Co., Ltd., Tokyo (JP)

(72) Inventor: Chizuko Kiribuchi, Tokyo (JP)

(73) Assignee: People Co., Ltd., Tokyo (JP)

( * ) Notice: Subject to any disclaimer, the term of this patent is extended or adjusted under 35 U.S.C. 154(b) by 0 days.

(21) Appl. No.: 15/329,663

(22) PCT Filed: Aug. 5, 2015

(86) PCT No.: PCT/JP2015/072214

§ 371 (c)(1),
(2) Date: Jan. 27, 2017

(87) PCT Pub. No.: WO2016/021631

PCT Pub. Date: Feb. 11, 2016

(65) Prior Publication Data

US 2017/0216737 A1 Aug. 3, 2017

(30) Foreign Application Priority Data

Aug. 8, 2014 (JP) ..... 2014-162329

(51) Int. Cl.
*A63H 33/04* (2006.01)
*A63H 33/26* (2006.01)
*A63F 9/00* (2006.01)

(52) U.S. Cl.
CPC ..... *A63H 33/046* (2013.01); *A63H 33/26* (2013.01)

(58) Field of Classification Search
CPC ..... A63H 33/00; A63H 33/04; A63H 33/08; A63H 33/16; A63H 33/26; A63H 33/046;
(Continued)

(56) References Cited

U.S. PATENT DOCUMENTS 5,746,638 A * 5/1998 Shiraishi ..... A63H 33/046 446/131
6,241,249 B1 * 6/2001 Wang ..... A63F 9/1204 273/156

(Continued)

FOREIGN PATENT DOCUMENTS

JP H08-257252 A 10/1996
JP 3052774 U 10/1998

(Continued)

OTHER PUBLICATIONS

International Search Report issued in PCT/JP2015/072214; dated Nov. 10, 2015.

(Continued)

*Primary Examiner* — Kien Nguyen
(74) *Attorney, Agent, or Firm* — Studebaker & Brackett PC

(57) ABSTRACT

A magnetic block toy includes: a block body having, on outer surfaces thereof, coupling sections and non-coupling sections; and disk magnets provided inside the coupling sections in the block body. The block body includes magnet-holding portions where the disk magnets are arranged along the coupling sections and held in a circumferentially rotatable manner. Length of at least one side of the block body is equal to or longer than 30 millimeters and shorter than 40 millimeters. Only the coupling sections are provided with labels indicative of being capable of coupling to a coupling target. In the coupling sections, stepped portions are formed so that at least part of an outer-edge portion of each coupling section protrudes.

14 Claims, 6 Drawing Sheets

(58) Field of Classification Search
CPC .. A63F 9/00; A63F 9/1204; A63F 2009/1212; Y10T 24/32
USPC ..... 446/85, 92, 129, 131, 134, 138; 273/156
See application file for complete search history.

(56) References Cited

U.S. PATENT DOCUMENTS

| | | | | |
|---|---|---|---|---|
| 6,749,480 | B1 * | 6/2004 | Hunts | A63H 33/046 446/85 |
| 8,850,683 | B2 * | 10/2014 | Haughey | A63H 33/046 29/428 |

FOREIGN PATENT DOCUMENTS

| | | | |
|---|---|---|---|
| JP | 2006-055231 | A | 3/2006 |
| JP | 3130523 | U | 3/2007 |
| JP | 2010-511471 | A | 4/2010 |
| JP | 2011-510768 | A | 4/2011 |
| NO | 2008/069549 | A1 | 6/2008 |
| NO | 2009/097852 | A1 | 8/2009 |

OTHER PUBLICATIONS

New Products Pythagoras Blocks; Toy Journal; Aug. 1, 2014; No. 1246; pp. 83.
Notification of Transmittal of International Preliminary Report on Patentability and Translation of Written Opinion of the International Searching Authority, PCT/JP2015/072214; dated Feb. 23, 2017.

* cited by examiner

MAGNETIC BLOCK TOY

TECHNICAL FIELD

One aspect of the present invention relates to a magnetic block toy.

BACKGROUND ART

Conventionally, a block toy has been known as one of intellectual-training toys. Development of creativity and imagination of infants through playing with the block toy has been attempted. As a technology for this kind of application, Patent Literature 1, for example, describes a magnetic block toy that is to be magnetically coupled to a coupling target. This magnetic block toy has magnets that are embedded inside a plurality of surfaces. This magnetic block toy is to be magnetically coupled to another magnetic block toy by using magnetic force of the magnets.

CITATION LIST

Patent Literature

Patent Literature 1: Japanese Utility Model Registration No. 3130523

SUMMARY OF INVENTION

Technical Problem

The target users of such magnetic block toys as described above are infants aged about 1.5 years or older, for example. It is desired that the magnetic block toys have excellent usability for such infants and can keep this excellent usability for a long period of time. In this point, the above-described magnetic block toys still have room for improvement.

In view of this, one aspect of the present invention provides a magnetic block toy that has excellent usability for infants and can keep this usability for a long period of time.

Solution to Problem

A magnetic block toy according to one aspect of the present invention is a magnetic block toy that is magnetically coupled to a coupling target. The magnetic block toy includes: a block body having, on outer surfaces thereof, a coupling section that is a plane section capable of magnetically coupling to the coupling target and a non-coupling section that is a plane section incapable of magnetically coupling to the coupling target; and a disk magnet provided inside the coupling section in the block body and having a north-pole portion and a south-pole portion aligned along a circumferential direction thereof. The block body includes a magnet-holding portion in which the disk magnet is arranged along the coupling section and held in a circumferentially rotatable manner. Length of at least one side of the block body is equal to or longer than 30 millimeters and shorter than 40 millimeters. Only the coupling section out of the coupling section and the non-coupling section is provided with a predetermined label indicative of being capable of coupling to the coupling target. In the coupling section, a stepped portion is formed so that at least part of an outer-edge portion of the coupling section protrudes.

In the magnetic block toy of the one aspect of the present invention, the predetermined label indicative of being capable of coupling to the coupling target is provided on the coupling section. This configuration enables infants to easily distinguish between the coupling section and the non-coupling section. The length of at least one side of the block body is equal to or longer than 30 millimeters and shorter than 40 millimeters. This configuration enables infants to easily use the toy, and thus can improve usability for infants. In the coupling section, the stepped portion is formed. This stepped portion prevents the predetermined label from being easily damaged when the magnetic block toy is magnetically coupled to the coupling target (e.g., another magnetic block toy) with this coupling section, and thus durability of the predetermined label can be increased. Accordingly, excellent usability for infants can be kept for a long period of time.

The predetermined label may include a figure including a figure schematically illustrating a projecting shape of a fitting structure in which the projecting shape fits into a recessed shape, and formed by painting. In this case, the predetermined label can cause infants to imagine the projecting shape of the fitting structure. This configuration enables the infants to more easily distinguish between the coupling section and the non-coupling section.

The magnetic block toy may further include a yoke adjacent to an inner side of the block body with respect to the disk magnet, and the block body may consist of one box member and one lid member. In this case, because the magnetic block toy includes the yoke, the coupling force generated by the disk magnet is enhanced, whereby the disk magnet can be downsized, and consequently the block body can be downsized. Because the block body is formed of the two members, manufacturing can be facilitated.

The part of the stepped portion may be formed from the lid member jutting out between the lid member and the box member at the outer surface. In this case, the part of the stepped portion can be formed by utilizing characteristics of the two members, the lid member and the box member. With this configuration, the above-described effects of the stepped portion can be easily and effectively achieved.

The block body may include a first coupling section and a second coupling section as the coupling section, the first coupling section being provided on the outer surface on one side of a predetermined direction, the second coupling section being provided on the outer surface on the other side in the predetermined direction, and may include a first disk magnet and a second disk magnet as the disk magnet, the first disk magnet being provided inside the first coupling section, the second disk magnet being provided inside the second coupling section. The first disk magnet and the second disk magnet may be arranged so as not to overlap each other or may be arranged so as to overlap each other via a partition member when seen from the predetermined direction. In this case, inside the block body, the first disk magnet and the second disk magnet hardly interfere with each other. Thus, the coupling force onto the coupling target can be prevented from decreasing.

Advantageous Effects of Invention

According to one aspect of the present invention, a magnetic block toy can be provided that has excellent usability for infants and can keep this usability for a long period of time.

DESCRIPTION OF EMBODIMENTS

Embodiments will be described hereinafter in detail with reference to the attached drawings. In the following description, like numerals are given to the same or equivalent elements, and duplicated explanation is omitted.

First Embodiment

Figure 1A:
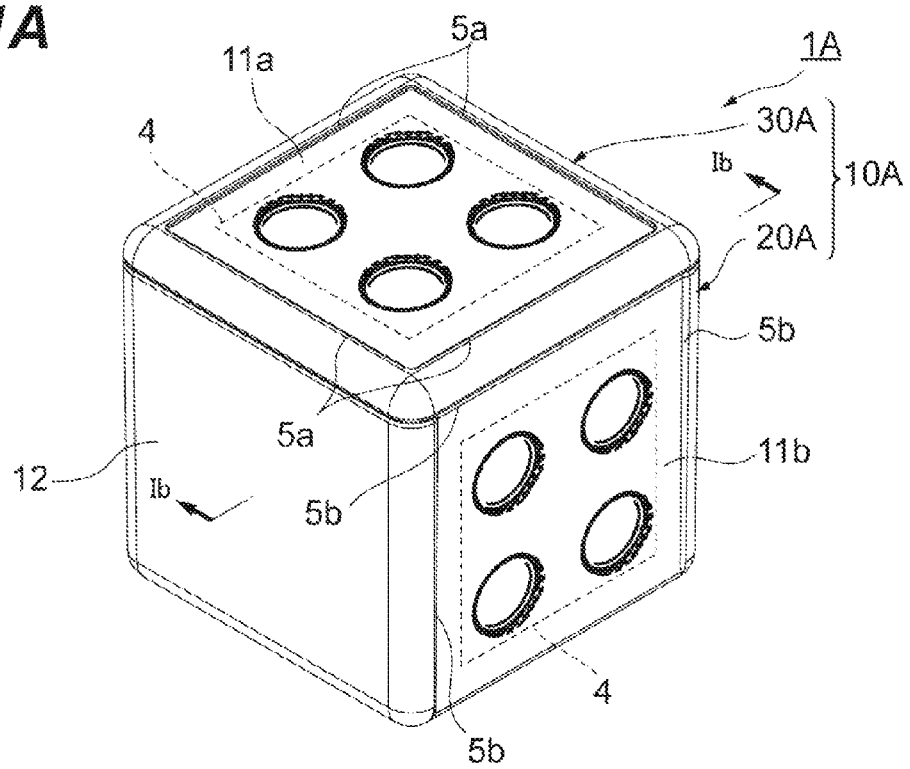
FIG. 1A is a perspective view of a magnetic block toy according to a first embodiment.
Figure 1B:
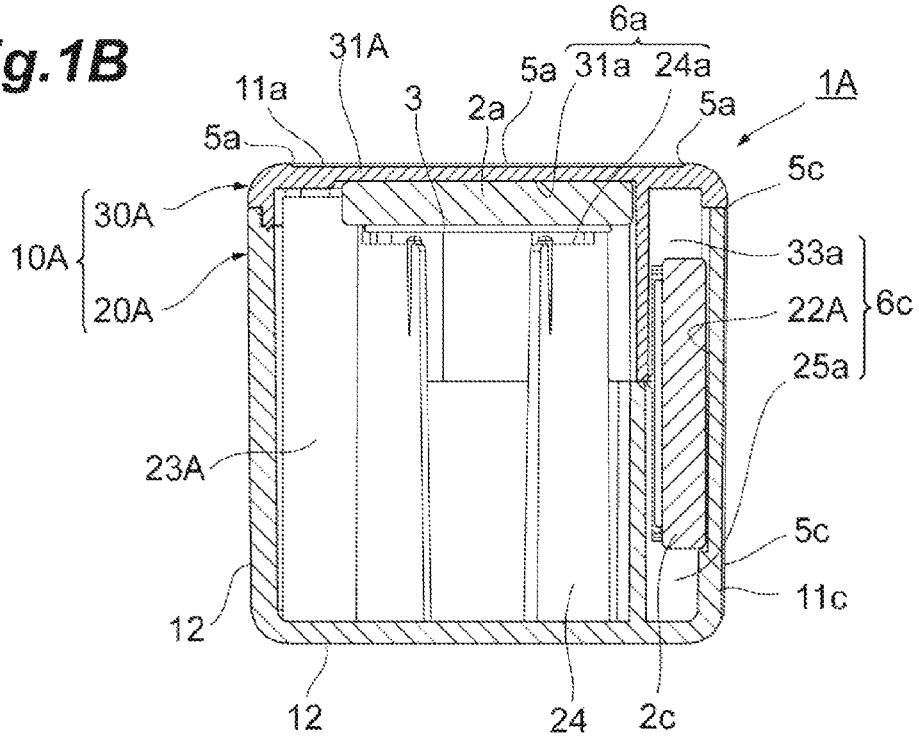
FIG. 1B is a sectional view of FIG. 1A along line Ib-Ib.
Figure 2A:
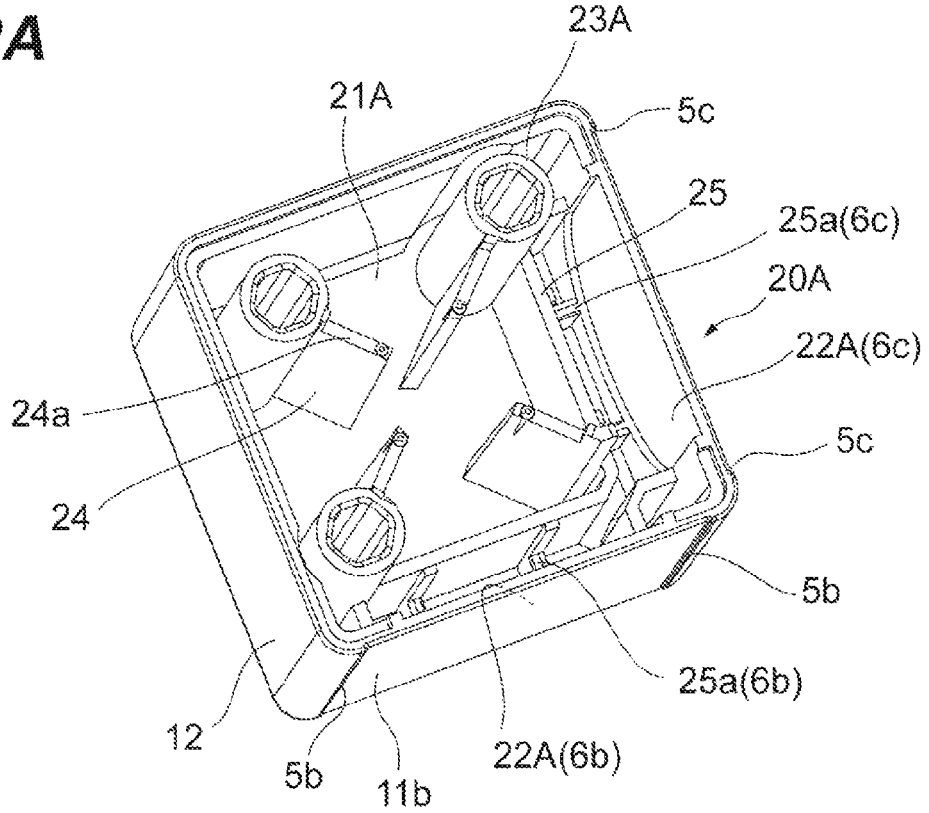
FIG. 2A is a perspective view of a box member of the magnetic block toy in FIGS. 1A and 1B.
Figure 2B:
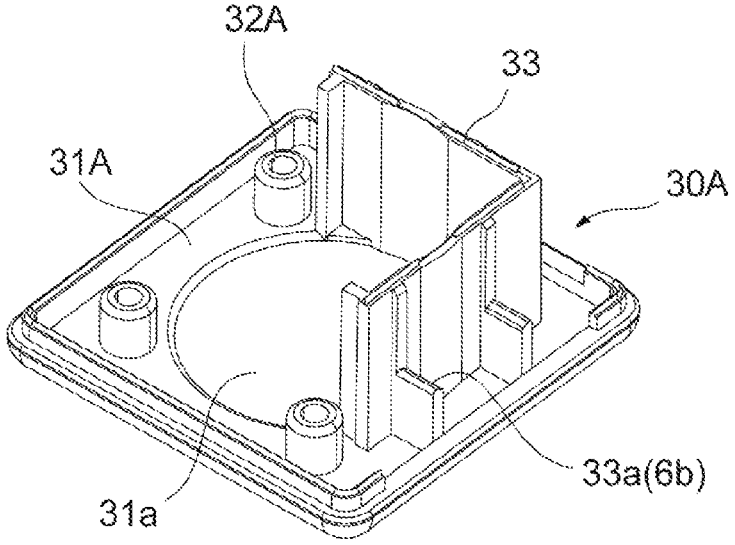
FIG. 2B is a perspective view of a lid member of the magnetic block toy in FIGS. 1A and 1B.

The following describes a first embodiment. FIG. 1A is a perspective view of a magnetic block toy according to the first embodiment, and FIG. 1B is a sectional view of FIG. 1A along line Ib-Ib. FIG. 2A is a perspective view of a box member of the magnetic block toy in FIGS. 1A and 1B, and FIG. 2B is a perspective view of a lid member of the magnetic block toy in FIGS. 1A and 1B. As depicted in FIGS. 1A to 2B, this magnetic block toy 1A of the first embodiment is an intellectual-training block toy. The magnetic block toy 1A is magnetically coupled to a coupling target by using magnetic force of a magnet. The coupling target is a member containing ferromagnetic material such as iron. The coupling target of the present embodiment is another magnetic block toy 1A' (see FIG. 3) rather than the magnetic block toy 1A. The other magnetic block toy 1A' has the same configuration as that of the magnetic block toy 1A.

The magnetic block toy 1A includes a block body 10A in a cubic shape having an outer surface that consists of six surfaces, three disk magnets 2*a* to 2*c* (see FIG. 3 as for the disk magnet 2*b*) provided inside the block body 10A, and three yokes 3 provided inside the block body 10A. The block body 10A has outer dimensions of 33 mm×33 mm×33 mm, for example. According to a safety standard for toys, from a viewpoint of preventing accidental swallowing, toys for infants aged 1.5 years are required not to pass through a cylinder having a predetermined size (what is called a small parts cylinder). The block body 10A having such an outer diameter can satisfy the standard.

The block body 10A consists of a box member 20A and a lid member 30A. The box member 20A and the lid member 30A are made of, for example, resin such as plastic. Because the box member 20A and the lid member 30A are made of resin, these members can be easily manufactured by, for example, injection molding. For example, using various colors of plastic materials as the materials of the box member 20A and the lid member 30A can increase infants' interest.

The box member 20A is a box-shaped member having an opening formed on one surface of a cube. The box member 20A includes a bottom portion 21A and four side-wall portions 22A. Inside the box member 20A, at three out of four corners of the bottom portion 21A, cylindrical box-side engaging portions 23A are provided each in a standing condition. Inside the box member 20A, four rectangular plate members 24 each having one side that extends to the vicinity of the center from a corresponding corner in the four corners of the bottom portion 21A are provided in a standing condition. In an end portion of each plate member 24 on an opening side, a cut-off portion 24*a* is formed. The cut-off portion 24*a* is formed by cutting off in a rectangular manner the central side of the end portion of each plate member 24 on the opening side. In other words, this end portion has a stepped shape because of the cut-off portion 24*a*.

To the bottom portion 21A, a box-side inner wall 25 is provided in a standing condition in a sectional L-shape. The corner portion of this L-shape of the box-side inner wall 25 is arranged at one corner at which none of the box-side engaging portions 23A is provided in the bottom portion 21A. Both ends of the L-shape are connected to the respective box-side engaging portions 23A. The box-side inner wall 25 is provided along the side-wall portions 22A a predetermined distance inside the neighboring side-wall portions 22A. The height of the box-side inner wall 25 is about half the height of the side-wall portions 22A. In the box-side inner wall 25, a plurality of restraining portions 25*a* are formed on surfaces facing the neighboring side-wall portions 22A. The restraining portions 25*a* each have an L-shape along the corner portion formed by the bottom portion 21A and the box-side inner wall 25.

The lid member 30A is a member having a lid shape that covers the opening of the box member 20A, and includes a square plane portion 31A. The outer-edge portions of the plane portion 31A are bent toward a surface that is inside the block body 10A (hereinafter, referred to as an "inner surface"), standing upright. To the inner surface of the plane portion 31A, cylindrical lid-side engaging portions 32A corresponding to the box-side engaging portions 23A are provided in a standing condition. The lid-side engaging portions 32A are formed so that the outer diameter thereof matches the inner diameter of the box-side engaging portions 23A. The lid-side engaging portions 32A are fit into the respective box-side engaging portions 23A. With this configuration, the lid member 30A engages with the box member 20A, whereby the integrated block body 10A is obtained.

To the inner surface of the plane portion 31A, a lid-side inner wall 33 corresponding to the box-side inner wall 25 is provided in a manner protruding in a sectional L-shape. The height of the lid-side inner wall 33 is the same as the height of the box-side inner wall 25. When the box member 20A and the lid member 30A are integrated, the end portion of the lid-side inner wall 33 on the tip side is caused to abut the end portion of the box-side inner wall 25 on the opening side. To the outer surface of the lid-side inner wall 33, a plurality of restraining portions 33*a* corresponding to the restraining portions 25*a* of the box-side inner wall 25 are formed. The restraining portions 33*a* each have an L-shape along the corner portion formed by the bottom portion 21A and the lid-side inner wall 33. In the central area of the inner surface of the plane portion 31A, a circular recessed portion 31*a* is formed. The diameter of the circular recessed portion 31*a* corresponds to the diameter of the disk magnet 2*a*.

The lid member 30A is arranged on the end surface of the box member 20A on the opening side so as to cover the opening. At this arrangement, portions of the box member 20A and the lid member 30A at which these members are caused to abut each other and that lie along the outer surfaces are joined together by high-frequency welding, for example. The specific portions thus joined are the end surfaces of the side-wall portions 22A on the opening side of the box member 20A and the end surface of outer-edge portion of the plane portion 31A in the lid member 30A. This configuration can prevent the box member 20A and the lid member 30A from being separated, thereby preventing infants from accidentally swallowing the disk magnets 2*a* to 2*c* and the yokes 3 in the block body 10A.

The disk magnets 2*a* to 2*c* each have approximate outer dimensions of 20 millimeters in diameter and 3 millimeters in thickness, for example. The disk magnets 2*a* to 2*c* are ferrite magnets, for example. The disk magnets 2*a* to 2*c* each have a north-pole portion and a south-pole portion aligned along the circumferential direction thereof. Specifically, one of semicircular portions into which each of the disk magnets 2*a* to 2*c* is divided is the north-pole portion, and the other is the south-pole portion. In the present embodiment, the same members are used for the disk magnets 2*a* to 2*c*.

The yokes 3 each have a disk shape having a diameter smaller than that of the disk magnets 2*a* to 2*c*. The yokes 3 each have approximate outer dimensions of 17 millimeters in diameter and 0.5 millimeter in thickness, for example. The yokes 3 are made of iron, for example. The yokes 3 are provided to the sides of the disk magnets 2*a* to 2*c* facing the inner sides of the block body 10A in a close contact manner.

Herein, the block body 10A has, on its outer surfaces, three coupling sections 11*a* to 11*c* that are plane sections each of which can be magnetically coupled to a coupling target and is square. The block body 10A has, on its outer portions other than the outer surfaces, non-coupling sections 12 that are plane sections each of which cannot be magnetically coupled to the coupling target and is square. Herein, the coupling section 11*a* and the coupling section 11*b* are adjacent each other. One (on the left in FIG. 1A) of plane sections that are adjacent to both of the coupling sections 11*a* and 11*b* belongs to the non-coupling sections 12, and the other is the coupling section 11*c*. The respective plane sections opposed to the coupling sections 11*a* and 11*b* belong to the non-coupling sections 12.

The block body 10A has magnet-holding portions 6*a* to 6*c* that respectively hold the disk magnets 2*a* to 2*c* inside the block body 10A. The magnet-holding portions 6*a* to 6*c* hold the disk magnets 2*a* to 2*c* in a circumferentially rotatable manner, with the disk magnets 2*a* to 2*c* being arranged therein along the coupling sections 11*a* to 11*c*. The magnet-holding portion 6*a* is constructed of the circular recessed portion 31*a* of the plane portion 31A of the lid member 30A and four cut-off portions 24*a* of the box member 20A, and holds the disk magnet 2*a* in the space formed between these components. The size of this space corresponds to the diametrical size and thickness of the disk magnet 2*a*. The respective magnet-holding portions 6*b* and 6*c* are constructed of the side-wall portions 22A of the box member 20A, the restraining portions 25*a* of the box member 20A, and the restraining portions 33*a* of lid member 30A, and hold the disk magnets 2*b* and 2*c* in the spaces formed in the middle of these components.

The coupling sections 11*a* to 11*c* are sections that are brought close to a coupling target so as to be in contact therewith when being used. The coupling sections 11*a* to 11*c* are sections inside which the disk magnets 2*a* to 2*c* are arranged. The expression that the coupling sections 11*a* to 11*c* can be coupled means that when the whole surfaces of the coupling sections 11*a* to 11*c* each are brought close to a coupling target, magnetic forces of the disk magnets 2*a* to 2*c* act thereon, so that the coupling sections 11*a* to 11*c* each can be magnetically coupled to the coupling target by the magnetic forces. The coupling sections 11*a* to 11*c* extend including the disk magnets 2*a* to 2*c* when seen from the opposite directions thereof. The coupling sections 11*a* to 11*c* herein are square outer surfaces of the block body 10A.

The non-coupling sections 12 are sections inside which the disk magnets 2*a* to 2*c* are not arranged. The expression that the non-coupling sections 12 cannot be coupled means that even when the whole surfaces of the non-coupling sections 12 each are brought close to a coupling target, the non-coupling sections 12 each cannot be magnetically coupled to the coupling target. The non-coupling sections 12 herein are outer surfaces other than the coupling sections 11*a* to 11*c* out of the square outer surfaces of the block body 10A. There is an occasion in which part of the non-coupling sections 12 can be coupled to a coupling target by the magnetic forces of the disk magnets 2*a* to 2*c* that are arranged near the non-coupling sections 12. However, in general, the non-coupling sections 12 are sections that cannot be coupled to the coupling target.

Out of the coupling sections 11*a* to 11*c* and the non-coupling sections 12, only the coupling sections 11*a* to 11*c* each are provided with a label (predetermined label) 4 indicative of being capable of coupling to a coupling target. The label 4 includes a figure schematically illustrating a projecting shape of a fitting structure in which the projecting shape fits into a recessed shape, and formed by painting. The projecting shape is a shape of studs, for example. The painting can be performed by pad printing, stencil, or spray, for example. The label 4 may be formed by carving or formed of a sticker.

In the coupling section 11*a*, a stepped portion 5*a* is formed along the respective four sides thereof. With the stepped portion 5*a*, the whole circumference of outer-edge portions of the coupling section 11*a* is protruded from the other portions thereof. In other words, the stepped portion 5*a* is formed so that the whole circumference of outer-edge portions of the coupling section 11*a* protrudes. In the coupling section 11*b*, a stepped portion 5*b* is formed along the respective three sides thereof. With the stepped portion 5*b*, three side portions out of outer-edge portions of the coupling section 11*b* protrude from the other portions. In other words, the stepped portion 5*b* is formed so that the three side portions out of rectangular outer-edge portions of the coupling section 11*b* protrude. In the coupling section 11*c*, a stepped portion 5*c* is formed along the respective three sides thereof. With the stepped portion 5*c*, three side portions out of the outer-edge portions of the coupling section 11*c* protrude from the other portions. In other words, the stepped portion 5*c* is formed so that the three side portions out of rectangular outer-edge portions of the coupling section 11*c* protrude. That is to say, the coupling sections 11*a* to 11*c* are respectively provided with the stepped portions 5*a* to 5*c* so that at least part of the outer-edge portions protrudes. The stepped portion 5*a* continuously extend in a shape of rectangular frame, and the stepped portions 5*b* and 5*c* continuously extend in a U-shape (portal-frame shape).

The stepped portions 5*b* and 5*c* on the side of the coupling section 11*a* (side of the lid member 30A) are formed from the lid member 30A jutting out between the lid member 30A and the box member 20A at the outer surfaces of the block body 10A. In other words, when the box member 20A and the lid member 30A are caused to abut each other, the end surface on the opening side of the side-wall portion 22A in the opening box member 20A and the end surface of the outer-edge portion of the plane portion 31A in the lid member 30A do not meet completely at an outer surface side, so that the latter one juts out.

The stepped portions 5*a* to 5*c* are provided to portions outside the respective labels 4 in the coupling sections 11*a* to 11*c*, in a manner surrounding the whole circumference or three sides of each label 4. In other words, the labels 4 are provided to portions inside the stepped portions 5*a* to 5*c* with the whole circumference or three sides thereof being surrounded by the stepped portions 5*a* to 5*c* in the coupling sections 11*a* to 11*c*. The height of the stepped portions 5*a* to 5*c* from the planes on which the labels 4 are provided only needs to be a height capable of preventing the labels 4 from contacting with each other. The upper limit of the height is a height sufficient for maintaining the coupling forces of the disk magnets 2*a* to 2*c*. Specifically, the height of the stepped portions 5*a* to 5*c* is 0.1 to 0.2 millimeter, for example.

It can be said that the outer-edge portions in the coupling sections 11*a* to 11*c* have the stepped portions 5*a* to 5*c* to form projecting portions that protrude toward the outside of the block body 10A from the planes provided for the labels 4. It can also be said that the planes on which the labels 4 are provided in the coupling sections 11*a* to 11*c* form, with the stepped portions 5*a* to 5*c*, recessed portions that are recessed toward the inside of the block body 10A from the outer-edge portions. It can also be said that the stepped portions 5*a* to 5*c* are formed so that the planes on which the labels 4 are provided are recessed.

Figure 3:
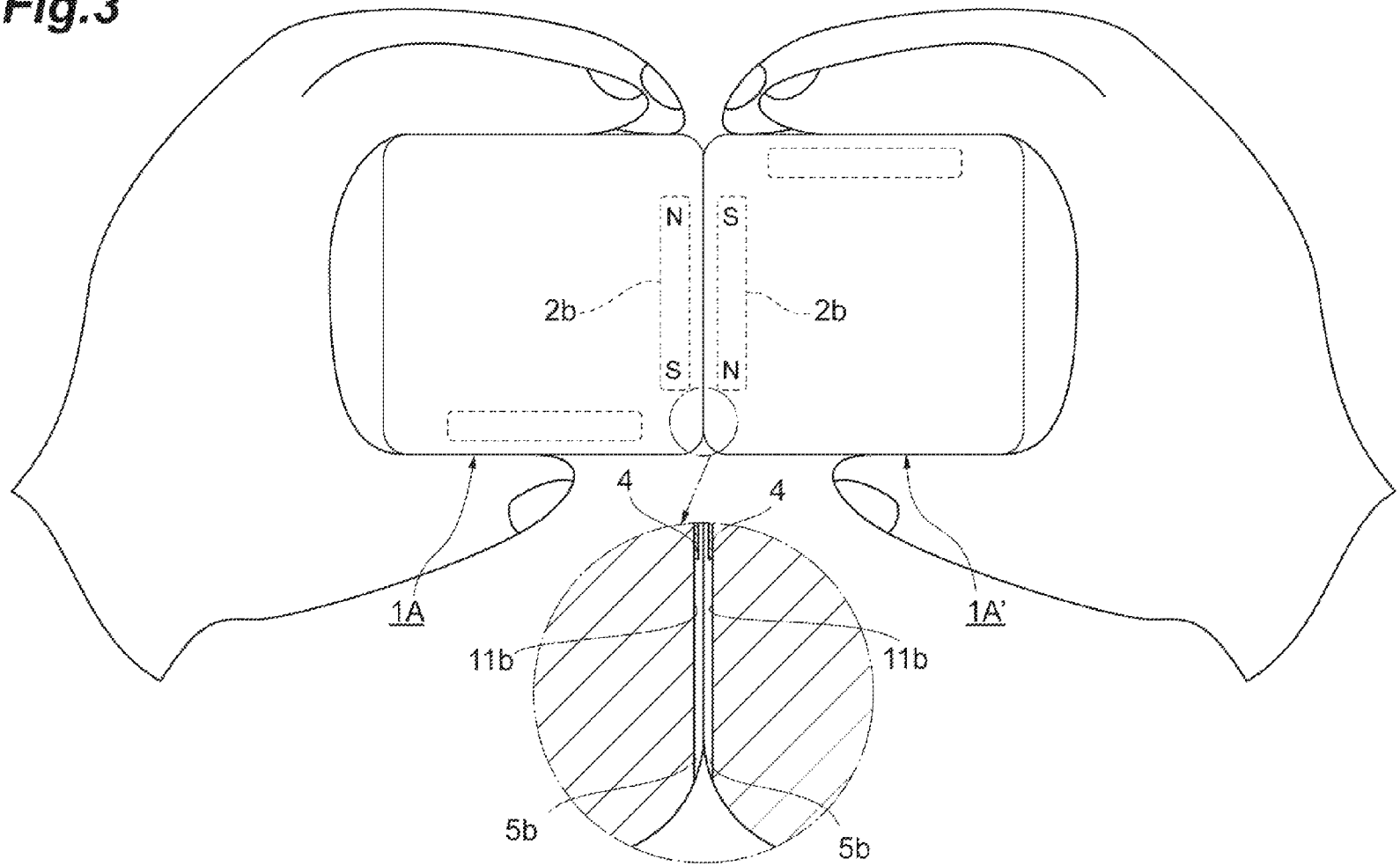
FIG. 3 is a diagram for explaining the magnetic block toy in FIGS. 1A and 1B when being used.

FIG. 3 is a diagram for explaining the magnetic block toy in FIG. 1 when being used. FIG. 3 illustrates a case as an example in which the coupling sections 11*b* and 11*b* are brought close to each other. An infant holds, with the hands, a magnetic block toy 1A and another magnetic block toy 1A' that is a coupling target and brings their coupling sections 11*b* and 11*b* close to each other. Accordingly, the north poles and the south poles of the disk magnets 2*b* and 2*b* respectively provided inside the coupling sections 11*b* and 11*b* are attracted to each other between. The disk magnets 2*b* and 2*b* rotate in the magnet-holding portions 6*b* and 6*b* if needed. Consequently, the magnetic block toys 1A and 1A' can be magnetically coupled to each other by using the magnetic forces of the disk magnets 2*b* and 2*b*.

At this time, as depicted in FIG. 3, the infant can visually distinguish the coupling sections 11*a* to 11*c* from the non-coupling sections 12 by seeing the labels 4. Thus, the infant can couple the magnetic block toys 1A and 1A' together as if to attach the fitting structures on the labels 4 and 4 to each other. Because the coupling sections 11*b* and 11*b* include the stepped portions 5*b* and 5*b*, the labels 4 and 4 are not in contact with each other in such a coupled state. In other words, when the magnetic block toy 1A is coupled to the other magnetic block toy 1A' that is the coupling target, the label 4 of the coupling section 11*b* being coupled in the magnetic block toy 1A is spaced apart from the label 4 of the coupling section 11*b* being coupled in the other magnetic block toy 1A'.

As described above, in the magnetic block toy 1A of the present embodiment, the labels 4 each indicative of being capable of coupling to a coupling target are provided only to the coupling sections 11*a* to 11*c*. Thus, the infant can easily distinguish the coupling sections 11*a* to 11*c* from the non-coupling sections 12. This can prevent a situation in which the infant cannot couple any of the non-coupling sections 12 to a coupling target even if the infant has tried, and consequently the infant becomes tired of playing.

Herein, the shortest side of a building block in a common size has a length of 4 to 4.5 centimeters, for example. This size is equivalent to the size of a palm of an ordinary one-year old infant ranging from 4 to 4.5 centimeters. In this case, all that the infant can do would be to pick up the building block or to put it down without doing anything additionally, and accordingly cannot handle the building block easily. A block toy having a longest side that is shorter than 3 centimeters is too small for a palm of an ordinary one-year old infant. In this case, the infant would grip the block toy, and accordingly he/she still cannot handle the block toy easily.

In view of this, in the magnetic block toy 1A of the present embodiment, at least one side of the block body 10A has a length that is equal to or longer than 30 millimeters and shorter than 40 millimeters. This size is a size for an object that the infant can hold with fingers. Thus, the infant can handle the magnetic block toy 1A easily. The usability for the infant can be improved. The above-described facts can be verified by monitoring tests for infants aged 1 year and 6 months to 1 year and 11 months as monitoring targets.

In the coupling sections 11*a* to 11*c*, the stepped portions 5*a* to 5*c* are formed so that at least part of the outer-edge portions thereof protrudes. Thus, the labels 4 hardly suffer damage caused by magnetic coupling to the other magnetic block toy 1A' with the coupling sections 11*a* to 11*c* and contact with another member such as collision with a floor by dropping. Thus, durability of the labels 4 can be increased. Accordingly, excellent usability for infants can be kept for a long period of time.

As described above, each label 4 includes a figure schematically illustrating a projecting shape of a fitting structure in which the projecting shape fits into a recessed shaped, and is provided by painting. Thus, the labels 4 can cause infants to imagine the projecting shape of the fitting structure. This configuration enables the infants to more easily distinguish the coupling sections 11*a* to 11*c* from the non-coupling sections 12.

Because the yokes 3 are provided, the coupling forces generated by the disk magnets 2*a* to 2*c* are enhanced. Thus, the disk magnets 2*a* to 2*c* can be downsized, and consequently the block body 10A can be downsized. In particular, when ferrite magnets having a coercive force lower than that of neodymium magnets are used, the yokes 3 can compensate for the low coercive force. The block body 10A is formed of two members, the box member 20A and the lid member 30A. Thus, the number of parts can be reduced, whereby manufacturing can be facilitated.

The stepped portions 5*b* and 5*c* on the side of the coupling section 11*a* (side of the lid member 30A) are formed from the lid member 30A jutting out between the lid member 30A and the box member 20A at the outer surfaces of the block body 10A. In this manner, parts of the stepped portions 5*a* to 5*c* are formed by utilizing characteristics of two members, the lid member 30A and the box member 20A. Thus, the effects of the stepped portions 5*a* to 5*c* can be easily and effectively achieved.

Second Embodiment

The following describes a second embodiment. In the description of the present embodiment, different points from the first embodiment will be mainly described.

Figure 4A:
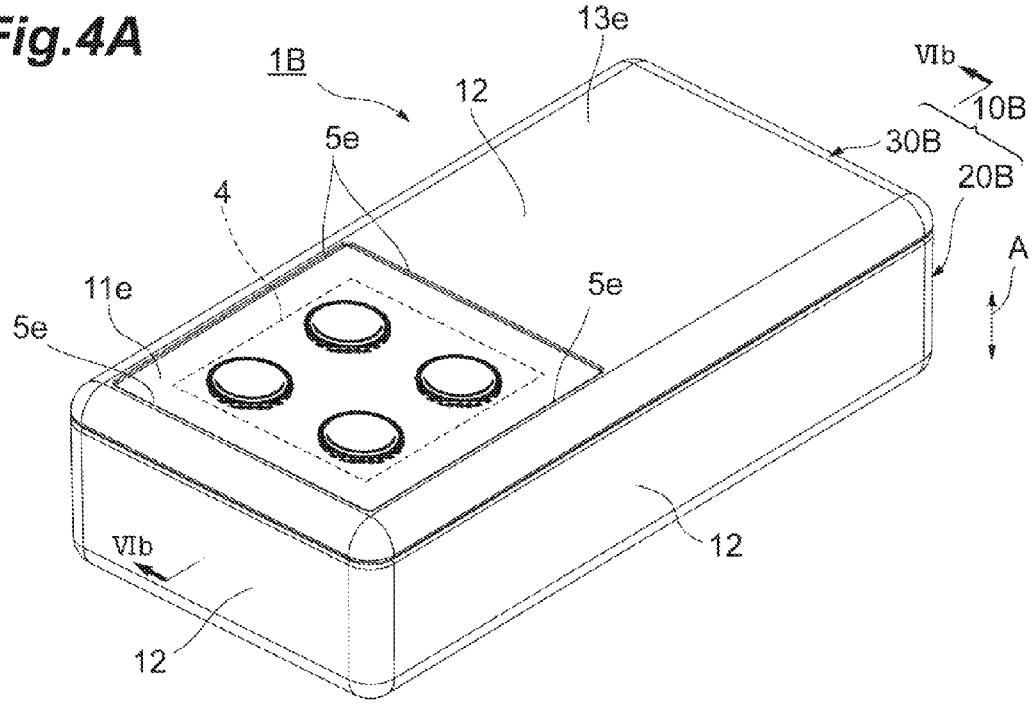
FIG. 4A is a perspective view of a magnetic block toy according to a second embodiment.
Figure 4B:
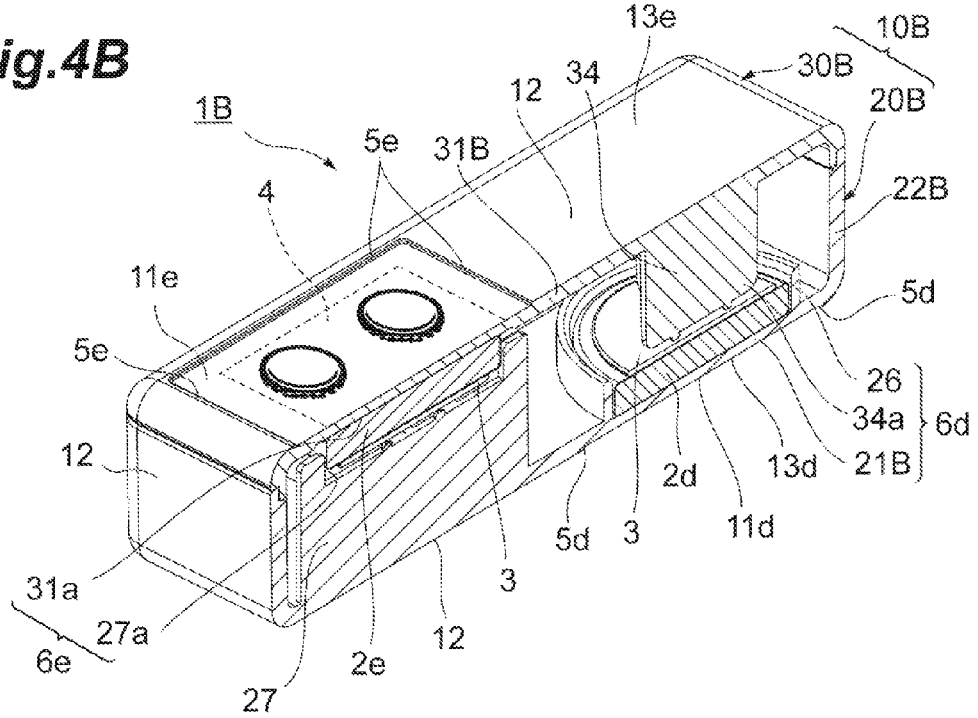
FIG. 4B is a sectional perspective view of FIG. 4A along line IVb-IVb.

FIG. 4A is a perspective view of a magnetic block toy according to the second embodiment, and FIG. 4B is a sectional perspective view of FIG. 4A along line IVb-IVb. This magnetic block toy 1B includes a cuboid-shaped block body 10B, disk magnets 2*d* and 2*e*, and two yokes 3. The block body 10B consists of a box member 20B and a lid member 30B.

The block body 10B has rectangular outer surfaces 13*d* and 13*e*. The outer surfaces 13*d* and 13*e* are opposed to each other in a predetermined direction A corresponding to the thickness direction thereof. The outer surfaces 13*d* and 13*e* each have an aspect ratio of two or more, for example, and the aspect ratio herein is set to be two. The block body 10B has outer dimensions of 33 mm×66 mm×16.5 mm, for example. In the present embodiment, the same members are used as the disk magnet 2*d* and the disk magnet 2*e*.

The box member 20B is a box-shaped member having an opening formed on one surface of a cuboid. The box member 20B includes a bottom portion 21B corresponding to the outer surface 13*d* and four side-wall portions 22B. Inside the box member 20B, on one side of the bottom portion 21B in the longitudinal direction, a cylindrical portion 26 is provided standing upright. Inside the box member 20B, on the other side of the bottom portion 21B in the longitudinal direction, a box-side cross-shaped member 27 is provided in a manner protruding. The inner diameter of the cylindrical portion 26 corresponds to the outer diameter of the disk magnet 2*d*. The box-side cross-shaped member 27 is a member having a cross shape when seen from the predetermined direction A. The size of this cross shape is a size that cannot be surrounded by the circle of the disk magnet 2*e*. The height of the box-side cross-shaped member 27 is the same as the height of the side-wall portion 22B. In an end portion of the box-side cross-shaped member 27 on the tip side, a cut-off portion 27*a* is formed. The cut-off portion 27*a* is formed by cutting off in a rectangular manner the central side of the end portion of the box-side cross-shaped member 27 on the tip side.

The lid member 30B is a member having a lid shape that covers the opening of the box member 20B. The lid member 30B includes a plane portion 31B corresponding to the outer surface 13*e*. The outer-edge portions of the plane portion 31B are bent inward so as to stand upright. On one side of the inner surface of the plane portion 31B in the longitudinal direction, a lid-side cross-shaped member 34 corresponding to the cylindrical portion 26 of the box member 20B is provided in a manner protruding. On the other side of the inner surface of the plane portion 31B in the longitudinal direction, a circular recessed portion 31*a* is formed. The lid-side cross-shaped member 34 is a member having a cross shape when seen from the predetermined direction A. The size of this cross shape is a size that can be surrounded by the circle of the disk magnet 2*d*. The height of the lid-side cross-shaped member 34 is substantially the same as the height of the box-side cross-shaped member 27. The diameter of the circular recessed portion 31*a* corresponds to the diameter of the disk magnet 2*e*.

Although not depicted, inside the box member 20B, cylindrical box-side engaging portions are provided in a standing condition at four corners of the bottom portion 21B. On the inner surface of the plane portion 31B of the lid member 30B, cylindrical lid-side engaging portions corresponding to the box-side engaging portions are provided in a standing condition. The lid member 30B is arranged on the end surface of the box member 20B on the opening side so as to cover the opening in an abutting manner along the predetermined direction A. At this arrangement, the lid-side engaging portions are fit, into the respective corresponding box-side engaging portions. With this configuration, the lid member 30B engages with the box member 20B, whereby the integrated block body 10B is obtained. Portions of the box member 20B and the lid member 30B at which these members are caused to abut each other and that lie along the outer surfaces are joined together by high-frequency welding, for example.

Herein, the block body 10B has, on its outer surfaces, a coupling section 11*d*, a coupling section 11*e*, and non-coupling sections 12. The coupling section 11*d* is provided on the outer surface 13*d*. The coupling section 11*e* is provided on the outer surface 13*e*. In other words, the box member 20B includes the coupling section 11*d* at the outer surface 13*d*. The lid member 30B includes the coupling section 11*e* at the outer surface 13*e*. The coupling section 11*d* and the coupling section 11*e* each are square. The coupling section 11*d* and the coupling section 11*e* are arranged shifted in the longitudinal direction of the outer surfaces 13*d* and 13*e* so as not to overlap each other when seen from the predetermined direction A. In the outer surface 13*d* and 13*e*, portions on which the coupling section 11*d* or the coupling section 11*e* is not provided belong to the non-coupling sections 12. All of four plane sections that are adjacent to both of the outer surfaces 13*d* and 13*e* belong to the non-coupling sections 12.

The block body 10B has a magnet-holding portion 6*d* and a magnet-holding portion 6*e* that respectively hold the disk magnet 2*d* and the disk magnet 2*e* inside the block body 10B. The magnet-holding portion 6*d* and the magnet-holding portion 6*e* hold the disk magnet 2*d* and the disk magnet 2*e* in a circumferentially rotatable manner, with the disk magnet 2*d* and the disk magnet 2*e* being arranged therein along the coupling section 11*d* and the coupling section 11*e*.

The magnet-holding portion 6*d* is constructed of the bottom portion 21B of the box member 20B, the cylindrical portion 26, and a tip portion 34*a* of the lid-side cross-shaped member 34 of the lid member 30B. The magnet-holding portion 6*d* holds the disk magnet 2*d* in the space formed in the middle of the bottom portion 21B, the cylindrical portion 26, and the tip portion 34*a*. The size of this space corresponds to the diametrical size and thickness of the disk magnet 2*d*. The magnet-holding portion 6*e* is constructed of the cut-off portion 27*a* of the box-side cross-shaped member 27 and the circular recessed portion 31*a* of the plane portion 31B of the lid member 30B. The magnet-holding portion 6*e* holds the disk magnet 2*e* in the space formed between the cut-off portion 27*a* and the circular recessed portion 31*a*. The size of this space corresponds to the diametrical size and thickness of the disk magnet 2*e*. In the block body 10B, the disk magnet 2*d* and the disk magnet 2*e* are arranged so as not to overlap each other when seen from the predetermined direction A.

The respective coupling sections 11*d* and 11*e* are provided with the labels 4. In the coupling sections 11*d* and 11*e*, stepped portions 5*d* and 5*e* are formed along the respective four sides thereof. Thus, the whole circumferences of the outer-edge portions of the coupling sections 11*d* and 11*e* protrude from the other portions. The stepped portions 5*d* and 5*e* continuously extend each in a shape of rectangular frame. The stepped portions 5*d* and 5*e* are provided to portions outside the respective labels 4 in the coupling sections 11*d* and 11*e* in a manner surrounding the whole circumference of each label 4. In other words, the labels 4 are provided to portions inside the stepped portions 5*d* and 5*e* with the whole circumferences thereof being surrounded by the stepped portions 5*d* and 5*e* in the coupling section 11*d* and the coupling section 11*e*. In the outer surfaces 13*d* and 13*e*, the outer-edge portions of the coupling sections 11*d* and 11 *e* form the same planes as the non-coupling sections 12.

It can be said that the outer-edge portions in the coupling sections 11*d* and 11*e* have the stepped portions 5*d* and 5*e* to form projecting portions that protrude toward the outside of the block body 10B from the planes provided for the labels 4. It can also be said that the planes on which the labels 4 are provided in the coupling sections 11*d* and 11*e* form, with the stepped portions 5*d* and 5*e*, recessed portions that are recessed toward the inside of the block body 10B from the outer-edge portions. It can also be said that the stepped portions 5*d* and 5*e* are formed so that the planes on which the labels 4 are provided are recessed.

In the present embodiment thus configured also, the labels 4 are provided only to the coupling section 11*d* and the coupling section 11*e*. Thus, infants can easily distinguish the coupling section 11*d* and the coupling section 11*e* from the non-coupling sections 12. At least one side of the block body 10B has a length equal to or longer than 30 millimeters and shorter than 40 millimeters. Thus, usability for the infants can be improved. In the coupling section 11*d* and the coupling section 11*e*, the stepped portions 5*d* and 5*e* are formed so that at least part of the outer-edge portions thereof protrudes. Thus, durability of the labels 4 can be increased. Accordingly, excellent usability for infants can be kept for a long period of time.

The block body 10B has the coupling section (first coupling section) 11*d* and the coupling section (second coupling section) 11*e* as the coupling section. The coupling section 11*d* is provided on the outer surface 13*d* on one side in the predetermined direction A and the coupling section 11*e* is provided on the outer surface 13*e* on the other side in the predetermined direction A. The magnetic block toy 1B includes the disk magnet 2*d* and the disk magnet 2*e* as the disk magnet. The disk magnet 2*d* is provided inside the coupling section 11*d* and the disk magnet 2*e* is provided inside the coupling section 11*e*. The disk magnet 2*d* and the disk magnet 2*e* are arranged so as not to overlap each other when seen from the predetermined direction A. Thus, inside the block body 10B, the disk magnet 2*d* and the disk magnet 2*e* hardly interfere with each other. Thus, the coupling force of the block body 10B onto the coupling target can be prevented from decreasing.

Because the disk magnet 2*d* and the disk magnet 2*e* are arranged in this manner, even if the thickness (length of a side along the predetermined direction A) of the block body 10B, i.e., the distance between the outer surfaces 13*d* and 13*e* is small in particular, the disk magnet 2*d* and the disk magnet 2*e* hardly interfere with each other inside the block body 10B. Thus, the effect of preventing the coupling force of the block body 10B onto the coupling target from decreasing is remarkable.

Third Embodiment

The following describes a third embodiment. In the description of the present embodiment, different points from the first embodiment will be mainly described.

Figure 5A:
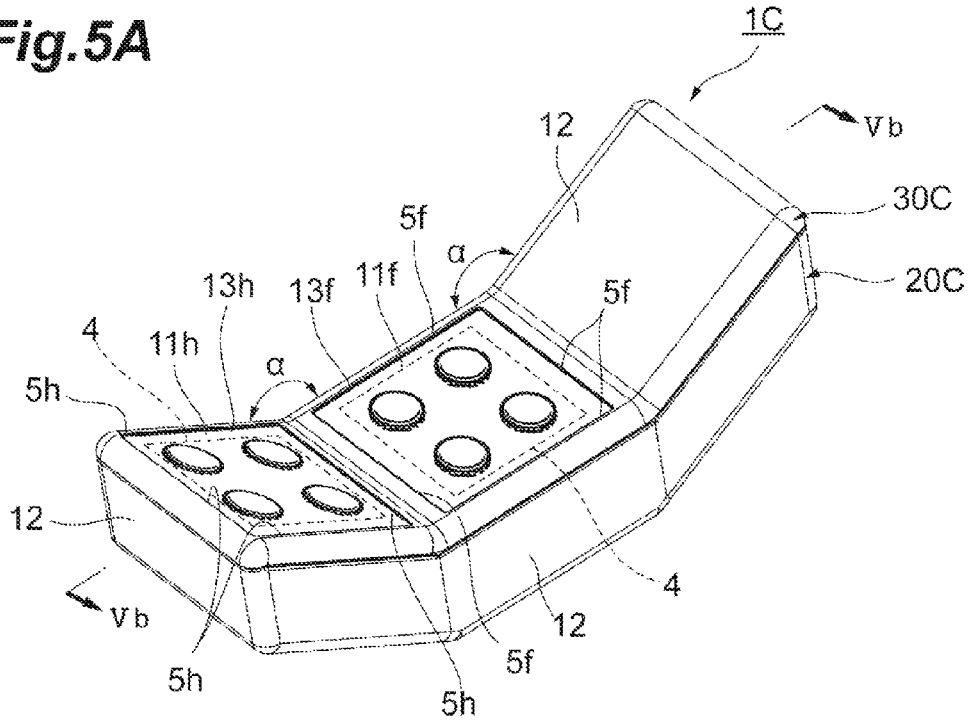
FIG. 5A is a perspective view of a magnetic block toy according to a third embodiment.
Figure 5B:
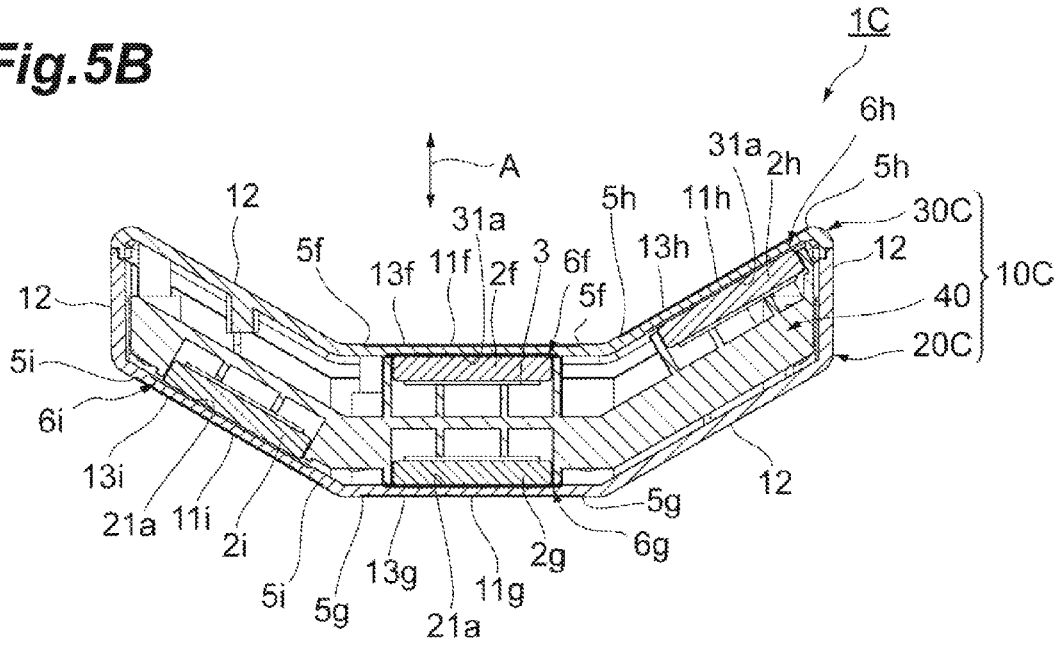
FIG. 5B is a sectional view of FIG. 5A along line Vb-Vb.
Figure 6:
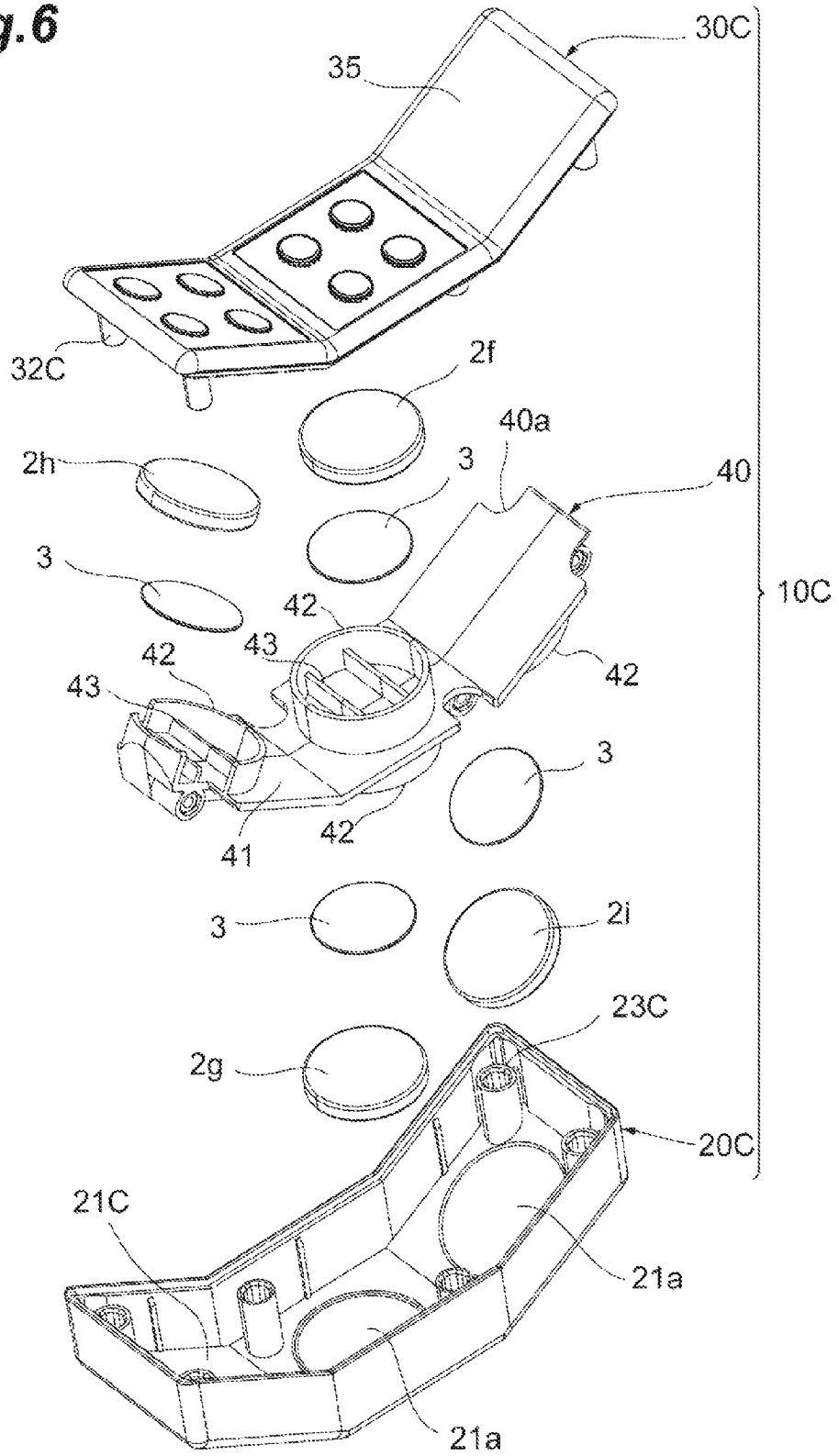
FIG. 6 is an exploded perspective view of the magnetic block toy in FIGS. 5A and 5B.

FIG. 5A is a perspective view of a magnetic block toy according to the third embodiment, and FIG. 5B is a sectional view of FIG. 5A along line Vb-Vb. FIG. 6 is an exploded perspective view of the magnetic block toy in FIGS. 5A and 5B. As depicted in FIGS. 5A to 6, this magnetic block toy 1C includes an arch-like block body 10C, disk magnets 2*f* to 2*i*, and four yokes 3.

The outer shape of the block body 10C is formed by connecting together three cuboid-like blocks in a predetermined angle $\alpha$ ($90° < \alpha < 180°$). In other words, the block body 10C has, as its outer surfaces, a pair of sections opposed to each other. Each section is a section formed by apposing three square plane sections. The square plane sections each have dimensions of 33 mm×33 mm, for example. In the present embodiment, as the disk magnets 2*f* to 2*i*, the same members are used.

The block body 10C has, as the square plane sections, coupling sections 11*f* to 11*i* and two non-coupling sections 12 on the outer surfaces. The coupling section 11*f* is provided to an outer surface 13*f* on one side of a predetermined direction A corresponding to the thickness direction. The coupling section 11*g* is provided to an outer surface 13*g* on the other side in the predetermined direction A. The coupling section 11*h* is provided to an outer surface 13*h* adjacent to the coupling section 11*f*. The coupling section 11*i* is provided to an outer surface 13*i* adjacent to the coupling section 11*g*. The non-coupling sections 12 are outer surfaces other than the outer surfaces 13*f* to 13*i*. The non-coupling sections 12 are provided to an outer surface opposed to the coupling section 11*h*, an outer surface opposed to the coupling section 11*i*, and four outer surfaces parallel to the predetermined direction A. The outer surfaces 13*f* and 13*g* are opposed to each other in the predetermined direction A, and the distance between the outer surfaces 13*f* and 13*g* along the predetermined direction A is 19 millimeters, for example.

The block body 10C has a box member 20C, a partition member 40, and a lid member 30C. The partition member 40 can be obtained by injection-molding the same plastic material as that of the box member 20C and the lid member 30C.

The box member 20C includes an arch-like bottom portion 21C. The bottom portion 21C is formed of three square plates connected together at the predetermined angle $\alpha$. The bottom portion 21C includes the outer surface 13*g* provided with the coupling section 11*g* and the outer surface 13*i* provided with the coupling section 11*i*. Inside the box member 20C, six cylindrical box-side engaging portions 23C are provided in a standing condition on the bottom portion 21C. On the bottom portion 21C, at the respective positions in the inner surface thereof corresponding to the coupling section 11*f* and the coupling section 11*h*, circular recessed portions 21*a* are formed. The diameter of the circular recessed portions 21*a* corresponds to the diameter of the disk magnet 2*f* and the disk magnet 2*h*.

The lid member 30C includes an arch-like coupling-plane portion 35. The coupling-plane portion 35 is formed of three square plates connected together at the predetermined angle $\alpha$ in the same manner as the bottom portion 21C. The coupling-plane portion 35 is bent inward so that the outer-edge portions thereof rise up. The coupling-plane portion 35 includes the outer surface 13*f* provided with the coupling section 11*f* and the outer surface 13*h* provided with the coupling section 11*h*. On the inner surface of the coupling-plane portion 35, six cylindrical lid-side engaging portions 32C corresponding to the box-side engaging portions 23C are provided in a standing condition. In the coupling-plane portion 35, at the respective positions in the inner surface thereof corresponding to the coupling section 11*g* and the coupling section 11*i*, circular recessed portions 31*a* are formed. The diameter of the circular recessed portions 31*a* corresponds to the diameter of the disk magnet 2*g* and the disk magnet 2*i*.

The lid member 30C is arranged on the end surface of the box member 20C on the opening side so as to cover the opening in an abutting manner along the predetermined direction A, with the box member 20C accommodating the partition member 40. At this arrangement, the lid-side engaging portions 32C are fit into the respective box-side engaging portions 23C. With this configuration, the lid member 30C engages with the box member 20C with the partition member 40 interposed therebetween, whereby the integrated block body 10C is obtained. Positions of the box member 20C and the lid member 30C at which these members are caused to abut each other and that lie along the outer surfaces are joined together by high-frequency welding, for example.

The partition member 40 includes a partition plate 41, four cylindrical portions 42, and restraining portions 43 provided to the respective cylindrical portions 42. The partition plate 41 is a member having an arch-like shape. The partition plate 41 is formed of three square plates connected together at the predetermined angle α in the same manner as the bottom portion 21C and the coupling-plane portion 35. The cylindrical portions 42 are provided on the surfaces of the partition plate 41 opposed to the outer surfaces 13*f* to 13*i* in a standing condition. The inner diameter of the cylindrical portions 42 corresponds to the outer diameter of the disk magnets 2*f* to 2*i*. The restraining portions 43 are rectangular plates, and are provided inside the cylindrical portions 42 in a standing condition on the partition plate 41. The restraining portions 43 are provided in plurality parallel to each other. In the partition member 40, six cut-off portions 40*a* are formed at portions that interfere with the lid-side engaging portions 32C and the box-side engaging portions 23C when the box member 20C and the lid member 30C are integrated.

The block body 10C has magnet-holding portions 6*f* to 6*i* that respectively hold the disk magnets 2*f* to 2*i* inside the block body 10C. The magnet-holding portions 6*f* to 6*i* hold the disk magnets 2*f* to 2*i* in a circumferentially rotatable manner, with the disk magnets 2*f* to 2*i* being arranged therein along the coupling sections 11*f* to 11*i*. The magnet-holding portions 6*f* to 6*i* are constructed of the cylindrical portions 42 and the restraining portions 43 of the partition member 40 and the circular recessed portions 21*a* and 31*a*. The magnet-holding portions 6*f* to 6*i* hold the disk magnets 2*f* to 2*i* in the spaces formed in the middle of the cylindrical portions 42, the restraining portions 43, and the circular recessed portions 21*a* and 31*a*. The size of the spaces corresponds to the diametrical size and thickness of the disk magnets 2*f* to 2*i*.

The respective coupling sections 11*f* to 11*i* are provided with the labels 4. In the coupling sections 11*f* to 11*i*, stepped portions 5*f* to 5*i* are formed so that the whole circumferences of the outer-edge portions thereof protrude. The stepped portions 5*f* to 5*i* continuously extend each in a shape of rectangular frame. The stepped portions 5*f* to 5*i* are provided to portions outside the respective labels 4 in the coupling sections 11*f* to 11*i* in a manner surrounding the whole circumference of each label 4. In other words, the labels 4 are provided to portions inside the stepped portions 5*f* to 5*i* with the whole circumferences thereof being surrounded by the stepped portions 5*f* to 5*i* in the coupling sections 11*f* to 11*i*.

It can be said that the outer-edge portions in the coupling sections 11*f* to 11*i* have the stepped portions 5*f* to 5*i* to form projecting portions that protrude toward the outside of the block body 10C from the planes provided for the labels 4. It can also be said that planes on which the labels 4 are provided in the coupling sections 11*f* to 11*i* form, with the stepped portions 5*f* to 5*i*, recessed portions that are recessed toward the inside of the block body 10C from the outer-edge portions. It can also be said that the stepped portions 5*f* to 5*i* are formed so that the planes on which the labels 4 are provided are recessed.

In the present embodiment thus configured also, the labels 4 are provided only to the coupling sections 11*f* to 11*i*. Thus, infants can easily distinguish these sections from the non-coupling sections 12. At least one side of the block body 10C has a length equal to or longer than 30 millimeters and shorter than 40 millimeters. Thus, usability for the infants can be improved. Furthermore, in the coupling sections 11*f* to 11*i*, the stepped portions 5*f* to 5*i* are formed so that at least part of the outer-edge portions thereof protrudes. Thus, durability of the labels 4 can be increased. Accordingly, excellent usability for infants can be kept for a long period of time.

The block body 10C has the coupling section (first coupling section) 11*f* and the coupling section (second coupling section) 11*g* as the coupling section. The coupling section 11*f* is provided on the outer surface 13*f* on one side in the predetermined direction A and the coupling section 11*g* is provided on the outer surface 13*g* on the other side in the predetermined direction A. The magnetic block toy 1C includes the disk magnet (first disk magnet) 2*f* and the disk magnet (second disk magnet) 2*g* as the disk magnet. The disk magnet 2*f* is provided inside the coupling section 11*f* and the disk magnet 2*g* is provided inside the coupling section 11*g*. The disk magnet 2*f* and the disk magnet 2*g* are arranged so as to overlap each other via a partition member when seen from the predetermined direction A. Thus, inside the block body 10C, the disk magnet 2*f* and the disk magnet 2*g* hardly interfere with each other. Thus, the coupling force of the block body 10C onto the coupling target can be prevented from decreasing.

Embodiments according to one aspect of the present invention have been described above. The one aspect of the present invention is not limited to the above-described embodiments, and may be modified within the scope without changing the gist described in each claim, or may be applied to another embodiment.

For example, the size of each of the block bodies 10A to 10C may be suitable as long as at least one side thereof has a length equal to or longer than 30 millimeters and shorter than 40 millimeters, for example. The shape of each of the block bodies 10A to 10C may be a cube, a cuboid, a quadrangular prism having a trapezoidal base, or a shape similar thereto. The shape of each of the block bodies 10A to 10C may be a polygonal prism such as a triangular prism, a pentagonal prism, and a hexagonal prism, a cylinder, or a shape similar thereto. The shape of each of the block bodies 10A to 10C may be a shape into which the above-described shapes are combined. The shape of each of the block bodies 10A to 10C may be a shape into which the above-described shapes and a wheel are combined, or may be a shape of an imitated ear of an animal.

In the above-described embodiments, the number of the coupling sections and the number of the non-coupling sections that the block body has are not limited to those described above. For example, in the first embodiment, the block body 10A has three coupling sections 11*a* to 11*c*, but the number of the coupling sections and the number of the non-coupling sections each only have to be one or more. In the second embodiment, the block body 10B has the coupling section 11*d* and the coupling sections 11*e*, but the number of the coupling sections only has to be two or more, and the number of the non-coupling section only has to be one or more. In the third embodiment, the block body 10C has the coupling section 11*f* to 11*i*, but the number of the coupling sections only has to be two or more, and the number of the non-coupling sections only has to be one or more. The coupling target may be a magnetic block toy that does not have a non-coupling section and has only a coupling section on the outer surface thereof.

In the above-described embodiments, arrangements (positional relations) of the coupling sections 11*a* to 11*i* and the non-coupling sections 12 in the block bodies 10A to 10C are not limited to those described above. Depending on the product specification, the coupling sections 11*a* to 11*i* and the non-coupling sections 12 may be appropriately arranged.

In the coupling sections 11*a* to 11*i*, the stepped portions 5*a* to 5*i* only have to be formed so that at least part of the outer-edge portions thereof protrudes. For example, the stepped portions 5*a* to 5*i* may be formed so that only portions corresponding to two sides of the square protrude. The stepped portions 5*a* to 5*i* may be discontinuous and, for example, may be formed by apposing a plurality of projections.

The outer shapes of the coupling sections 11*a* to 11*i* are not limited to those described above, and may be a square, an oblong, a rectangle, a polygon, or a circle (ellipse, oval, semicircle), for example, depending on the shapes of the block bodies 10A to 10C. Similarly, the outer shapes of the non-coupling sections 12 are not limited to those described above, and may be a square, an oblong, a rectangle, a polygon, or a circle (ellipse, oval, semicircle), for example, depending on the shapes of the block bodies 10A to 10C.

REFERENCE SIGNS LIST

1A-1C . . . magnetic block toys; 1A' . . . another magnetic block toy (coupling target); 2*a*-2*i* . . . disk magnets; 3 . . . yoke; 4 . . . label (predetermined label); 5*a*-5*i* . . . stepped portions; 6*a*-6*i* . . . magnet-holding portions; 10A-10C . . . block bodies; 11*a*-11*i* . . . coupling sections; 12 . . . non-coupling section; 13*d*-13*i* . . . outer surfaces; 20A-20C . . . box members; 30A-30C . . . lid members; 40 . . . partition member; A . . . predetermined direction.

The invention claimed is:

1. A magnetic block toy that is magnetically coupled to a coupling target, the magnetic block toy comprising:

a block body having, on outer surfaces thereof, a coupling section that is a plane section capable of magnetically coupling to the coupling target and a non-coupling section that is a plane section incapable of magnetically coupling to the coupling target; and a disk magnet provided inside the coupling section in the block body and having a north-pole portion and a south-pole portion aligned along a circumferential direction thereof, wherein the block body includes a magnet-holding portion in which the disk magnet is arranged along the coupling section and held in a circumferentially rotatable manner, length of at least one side of the block body is equal to or longer than 30 millimeters and shorter than 40 millimeters, only the coupling section out of the coupling section and the non-coupling section is provided with a predetermined label indicative of being capable of coupling to the coupling target, in the coupling section, a stepped portion is formed so that at least part of an outer-edge portion of the coupling section protrudes.

2. The magnetic block toy according to claim 1, wherein the predetermined label includes a figure including a figure schematically illustrating a projecting shape of a fitting structure in which the projecting shape fits into a recessed shape, and formed by painting.

3. The magnetic block toy according to claim 2, further includes a yoke adjacent to an inner side of the block body with respect to the disk magnet, and the block body consists of one box member and one lid member.

4. The magnetic block toy according to claim 3, wherein the part of the stepped portion is formed from the lid member jutting out between the lid member and the box member at the outer surface.

5. The magnetic block toy according to claim 2, comprising:

a first coupling section and a second coupling section as the coupling section, the first coupling section being provided on the outer surface on one side of a predetermined direction, the second coupling section being provided on the outer surface on the other side in the predetermined direction; and a first disk magnet and a second disk magnet as the disk magnet, the first disk magnet being provided inside the first coupling section, the second disk magnet being provided inside the second coupling section, wherein the first disk magnet and the second disk magnet are arranged so as not to overlap each other when seen from the predetermined direction.

6. The magnetic block toy according to claim 2, comprising:

a first coupling section and a second coupling section as the coupling section, the first coupling section being provided on the outer surface on one side of a predetermined direction, the second coupling section being provided on the outer surface on the other side in the predetermined direction; and a first disk magnet and a second disk magnet as the disk magnet, the first disk magnet being provided inside the first coupling section, the second disk magnet being provided inside the second coupling section, wherein the first disk magnet and the second disk magnet are arranged so as to overlap each other via a partition member when seen from the predetermined direction.

7. The magnetic block toy according to claim 2, wherein there is a plurality of the coupling sections, and the stepped portion is formed so that the whole circumference of the outer-edge portion of at least one of the coupling section protrudes.

8. The magnetic block toy according to claim 1, further includes a yoke adjacent to an inner side of the block body with respect to the disk magnet, and the block body consists of one box member and one lid member.

9. The magnetic block toy according to claim 8, wherein the part of the stepped portion is formed from the lid member jutting out between the lid member and the box member at the outer surface.

10. The magnetic block toy according to claim 1, comprising:

a first coupling section and a second coupling section as the coupling section, the first coupling section being provided on the outer surface on one side of a predetermined direction, the second coupling section being provided on the outer surface on the other side in the predetermined direction; and a first disk magnet and a second disk magnet as the disk magnet, the first disk magnet being provided inside the first coupling section, the second disk magnet being provided inside the second coupling section, wherein the first disk magnet and the second disk magnet are arranged so as not to overlap each other when seen from the predetermined direction.

11. The magnetic block toy according to claim 1, comprising:

a first coupling section and a second coupling section as the coupling section, the first coupling section being provided on the outer surface on one side of a predetermined direction, the second coupling section being provided on the outer surface on the other side in the predetermined direction; and a first disk magnet and a second disk magnet as the disk magnet, the first disk magnet being provided inside the first coupling section, the second disk magnet being provided inside the second coupling section, wherein the first disk magnet and the second disk magnet are arranged so as to overlap each other via a partition member when seen from the predetermined direction.

12. The magnetic block toy according to claim 1, wherein there is a plurality of the coupling sections, and the stepped portion is formed so that the whole circumference of the outer-edge portion of at least one of the coupling section protrudes.

13. The magnetic block toy according to claim 1, wherein there is a plurality of the coupling sections, and the stepped portion is formed so that three side portions out of rectangular outer-edge portions of the coupling section protrude.

14. The magnetic block toy according to claim 1, wherein the coupling target is another magnetic block toy, and when the magnetic block toy is coupled to the other magnetic block toy, the predetermined label of the coupling section being coupled in the other magnetic block toy is spaced apart from the label of the coupling section being coupled in the other magnetic block toy.

* * * * *